US005442428A

United States Patent [19]

Takahashi et al.

[11] Patent Number: 5,442,428

[45] Date of Patent: Aug. 15, 1995

[54] IMAGE RECORDING APPARATUS

[75] Inventors: Mitsuru Takahashi, Tokyo; Yasunori Kawaishi, Narashino; Hideo Yu; Toshiaki Motohashi, both of Tokyo; Katsuya Kawagoe, Kamakura; Hideki Kamiyama, Yokohama, all of Japan

[73] Assignee: Ricoh Company, Ltd., Tokyo, Japan

[21] Appl. No.: 246,499

[22] Filed: May 20, 1994

[30] Foreign Application Priority Data

May 20, 1993 [JP] Japan ..... 5-118754

[51] Int. Cl.[6] ..... G03G 13/16

[52] U.S. Cl. ..... 355/271; 355/326 R

[58] Field of Search ..... 355/271–276, 355/326 R, 327

[56] References Cited

U.S. PATENT DOCUMENTS 4,705,385 11/1987 Palm et al. .
4,788,572 11/1988 Slayton et al. .
5,073,793 12/1991 Fujiwara et al. ..... 355/326 R
5,189,478 2/1993 Hara et al. ..... 355/271
5,270,783 12/1993 Bisaiji et al. ..... 355/246
5,291,252 3/1994 Kawaishi ..... 355/271 X
5,327,199 7/1994 Sekine ..... 355/326 R

*Primary Examiner*—R. L. Moses
*Attorney, Agent, or Firm*—Oblon, Spivak, McClelland, Maier & Neustadt

[57] ABSTRACT

An image recording apparatus is disclosed which includes an intermediate transfer belt rotatable in a reciprocating motion. Before the belt is rotated back and forth for forming a composite toner image, it is rotated in the opposite direction to the image forming direction. This provides the belt with substantially the same deviation in both the forward movement and the reverse movement. Hence, the apparatus insures desirable images by preventing the individual toner images from being brought out of register due to the deviation of the belt.

10 Claims, 10 Drawing Sheets

IMAGE RECORDING APPARATUS

BACKGROUND OF THE INVENTION

The present invention relates to a color copier, color printer or similar image recording apparatus and, more particularly, to an image recording apparatus of the type having an image carrier, and an intermediate transfer belt passed over rollers and provided with guides to be prevented from deviating in position. In this type of apparatus, toner images of respective colors are sequentially formed on the image carrier and then transferred to the belt, which is rotated in a reciprocating motion, and the resulting composite toner image is transferred from the belt to a paper or similar recording medium.

In the above-described type of image recording apparatus, the intermediate transfer belt is generally rotated in opposite directions in a reciprocating motion, as mentioned above, or only in the forward direction for the transfer of the toner images from the image carrier to the belt. The forward rotation scheme is such that after the transfer of a toner image of first color to the belt, the belt is continuously rotated in the forward direction, a toner image of second color is transferred to belt with the leading edge thereof in register with that of the toner image of first color, and then toner images of third and fourth colors are sequentially transferred to the belt in the same manner. On the other hand, the reciprocation scheme is such that after the transfer of the toner image of first color to the belt, the belt is returned by the same distance as it moved in the forward direction (during the return, the belt is spaced apart from the image carrier), the toner image of second color is transferred to the belt with the leading edge thereof in register with that of the toner image of first color, and then toner images of third and fourth colors are sequentially transferred to the belt in the same manner.

Considering changes in the circumferential length of the belt, the reciprocation scheme, which returns the belt the same distance by use of a stepping motor or similar drive source, is advantageous over the forward rotation scheme. It has been reported that the belt deviates to either side due to, among others, the degree of parallelism of rollers over which it is passed, and that the deviation during forward movement and the deviation during reverse movement are opposite in direction. It follows that the deviations during forward movement and reverse movement are substantially equal to each other. Therefore, the individual toner images combined on the belt appear almost in accurate register.

However, assume an image recording apparatus having an intermediate transfer belt which is provided with guides at opposite edges thereof in order to be prevented from deviating to either side while in rotation. The problem with this kind of apparatus is that when the belt is continuously rotated in one direction, it is prevented from deviating more than a predetermined amount by the guides. When the reciprocation scheme is applied to such a belt, the belt does not deviate during the formation of a toner image of first color, i.e., while in forward rotation, due to the guides. However, in the event of reverse rotation, the belt deviates in the opposite direction noticeably. This is also true with the formation of toner images of second, third and fourth colors although the degree of deviation is reduced. As a result, the consecutive deviations are summed up to result in a substantial total deviation. Experiments showed that the total deviation of the belt ranges from 0.3 mm to 1 min.

SUMMARY OF THE INVENTION

It is, therefore, an object of the present invention to provide an image recording apparatus which insures high quality images by preventing individual images to be combined from being displaced due to the deviation of an intermediate transfer belt.

An image recording apparatus of the present invention has an image carrier for sequentially forming toner images of respective colors on the surface thereof, and an intermediate transfer belt passed over a plurality of rollers and rotatable in a reciprocating motion. The intermediate transfer belt has guides at opposite edges thereof for being prevented from deviating. The toner images are transferred from the image carrier to the intermediate transfer belt, which is in a reciprocation motion, one above the other, and then the resulting composite toner image is transferred to a recording medium. The intermediate transfer belt is rotated, before the sequential transfer of the toner images to the intermediate transfer belt, in a reverse direction opposite to a direction for image formation.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
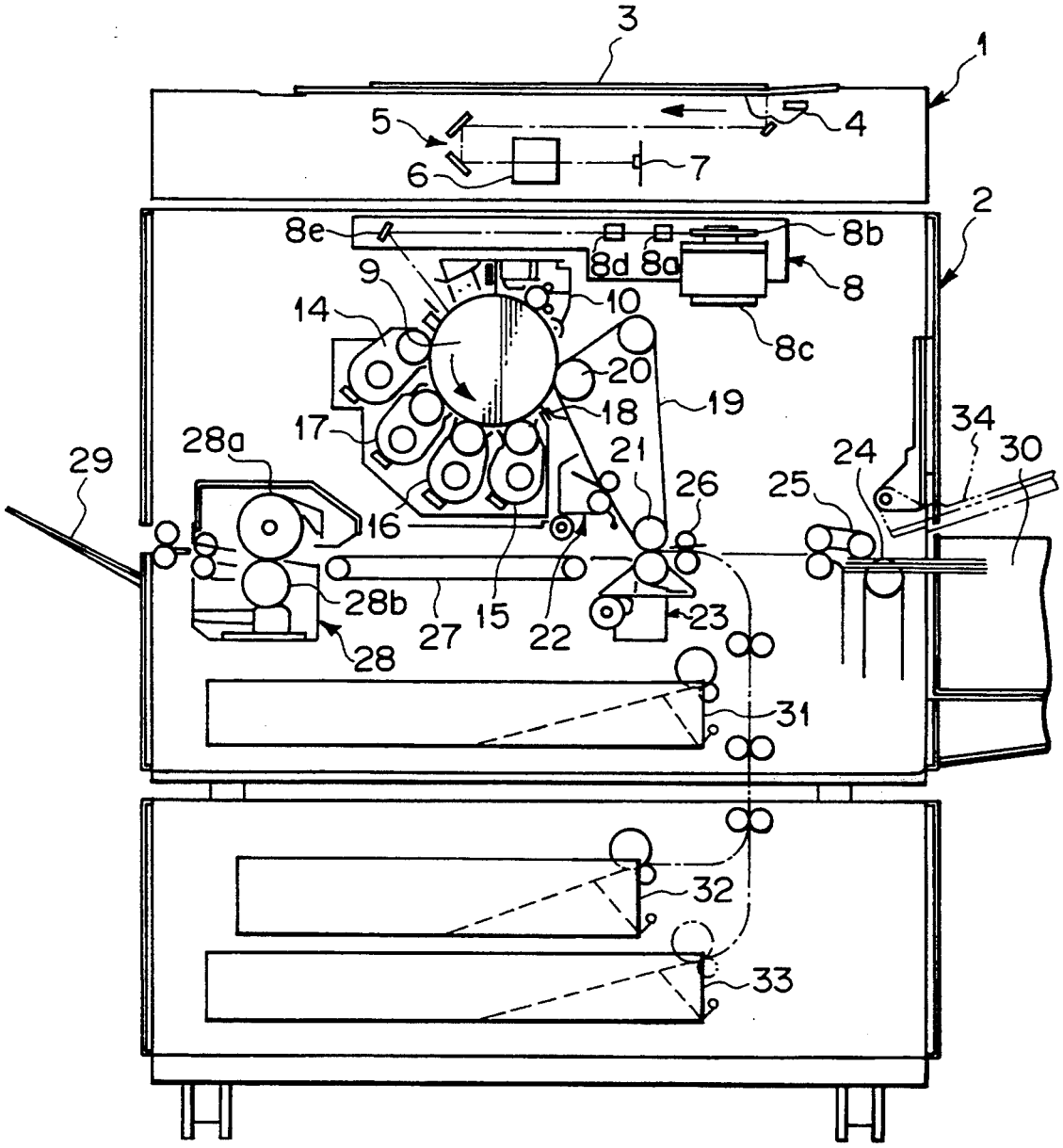
FIG. 1 is a section of an image recording apparatus embodying the present invention.
Figure 2:
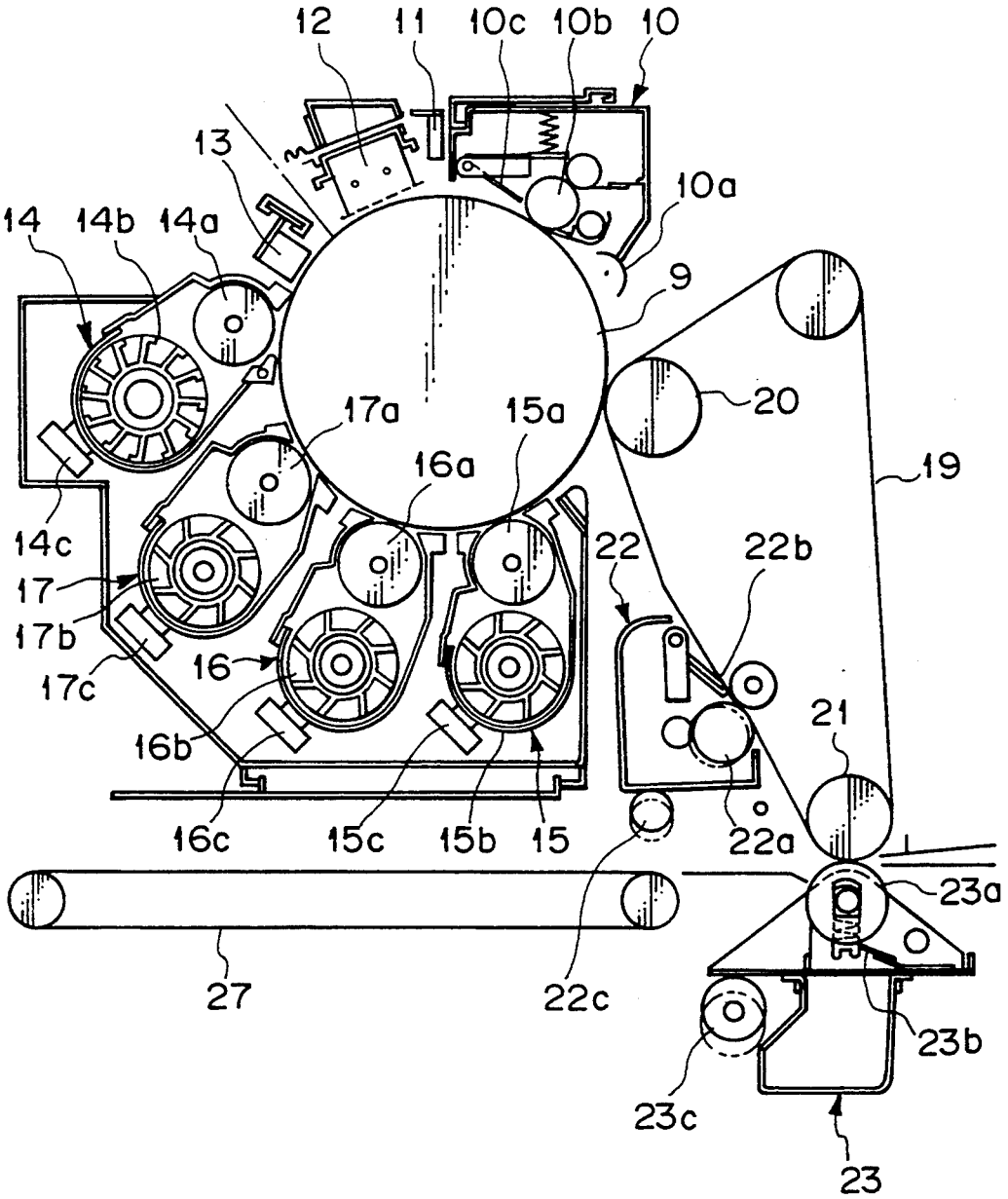
FIG. 2 is an enlarged section of a photoconductive element included in the embodiment, together with various units surrounding it.

Referring to FIGS. 1 and 2, an image forming apparatus embodying the present invention will be described which is implemented as a color copier by way of example. As shown, the copier has a color scanner, or color image reading device, 1, and optics including a lamp 4, mirrors 5, and a lens 6. The color scanner 1 focuses an image representative of a document 3 onto a color image sensor 7 via the optics, thereby reading blue (B), green (G) and red (R) image data. Specifically, the image sensor 7 converts such optical color components to corresponding electric signals. In the illustrative embodiment, the color sensor 7 is implemented by B, G and R color separating means and CCDs (Charge Coupled Devices) or similar photoelectric transducers and capable of reading the three colors B, G and R at a time. An image processing section, not shown, performs color conversion on the basis of the intensity levels of the B, G and R image signals generated by the color scanner 1, thereby outputting black (BK), cyan (C), magenta (M) and yellow (Y) color image data. A color printer 2 prints out the color image data by use of BK, C, M and Y color toners so as to produce a color copy.

To produce the BK, C, M and Y image data, the scanner 1 causes, on receiving a scanner start signal synchronous to the operation of the printer 2, the optics thereof to move in a direction indicated by an arrow in FIG. 1. Every time the optics scans the document 3, image data of one color is produced. As the optics scans the document 3 four consecutive times in total, image data of four colors are sequentially generated. The printer 2 sequentially forms BK, C, M and Y images with toners of corresponding colors. The BK, C, M and Y images are sequentially laid one upon the other to complete a four-color or full color image.

Specifically, the printer 2 has an optical writing unit 8 for converting the color image data from the scanner 1 to a corresponding optical signal. The optical signal scans a photoconductive drum 9 to electrostatically form a latent image represented by the image data of particular color. The writing unit 8 includes a laser 8*a*, a laser driver, not shown, a polygon mirror 8*b*, a motor 8*c* for rotating the mirror 8*b*, an f-theta lens 8*d*, and a mirror 8*e*.

As shown in FIG. 2, the drum 9 is rotatable counterclockwise. Arranged around the drum 9 are a drum cleaning unit, including a precleaning discharger, 10, a discharge lamp 11, a main charger 12, a potential sensor 13, a BK developing unit 14, a C developing unit 15, an M developing unit 16, a Y developing unit 17, a reference density pattern sensor 18, and an intermediate transfer belt 19. The developing units 14, 15, 16 and 17 respectively accommodate developing sleeves 14*a*, 15*a*, 16*a* and 17*a*, paddles 14*b*, 15*b*, 16*b* and 17*b*, and toner concentration sensors 14*c*, 15*c*, 16*c* and 17*c*. The sleeves 14*a*–17*a* are each rotatable to bring a developer of associated color deposited thereon into contact with the surface of the drum 9, thereby developing a latent image formed on the drum 9. The paddles 14*b*–17*b* are each rotatable to scoop up and agitate the developer. The sensors 14*c*–17*c* are each responsive to the toner concentration of the developer. In a stand-by condition, all the developers deposited on the sleeves 14*a*–17*a* are held in an inoperative condition. In the event of development, such developers are sequentially brought to an operative condition according to a predetermined color image forming order, e.g., in the order of BK, C, M and Y. As a result, latent images formed on the drum 9 are sequentially developed by the BK, C, M and Y developers or toners.

In operation, on the start of a copying operation, or cycle, the color scanner 1 starts reading BK image data at a predetermined timing. Based on the BK image data, a laser beam starts forming a BK latent image electrostatically. Before the leading edge of the BK latent image arrives at a developing position assigned to the BK developing unit 14, the sleeve 14*a* of the unit 14 is caused to rotate to render the developer deposited thereon operative. As a result, the BK latent image is sequentially developed by the BK toner from the leading edge to the trailing edge. As soon as the trailing edge of the BK latent image moves away from the developing position, the developer on the sleeve 14*a*, i.e., the developing unit 14 is rendered inoperative. The operation of the developing unit 14 is completed at least before the leading edge of a C latent image to follow reaches a developing position assigned to the C developing unit 15. To render the developer on the sleeve 14*a* inoperative, the rotation of the sleeve 14*a* is reversed.

A BK toner image formed on the drum 9 by the above procedure is transferred from the drum 9 to the intermediate transfer belt 19 which is rotating in synchronism with and at the same speed as the drum 9. Let the image transfer from the drum 9 to the belt 19 be referred to as belt transfer for the sake of simplicity. To effect the belt transfer, a predetermined bias voltage is applied to a bias roller 20 while the drum 9 and belt 19 are held in contact. The BK toner image and C, M and Y toner images to follow are sequentially formed on the drum 9 and transferred to the belt 19 one above the other, thereby completing a four-color image. Then, the four-color image is transferred from the belt 19 to a paper or similar recording medium at a time. The specific construction and operation of an intermediate transfer belt unit, including the belt 19, will be described later.

Regarding the drum 9, the BK imaging process is followed by a C imaging process. Specifically, the scanner 1 starts reading C image data at a predetermined timing. Based on the C image data, a laser beam starts writing a C latent image on the drum 9 electrostatically. After the trailing edge of the BK latent image has moved away from the developing position of the C developing unit 15 and before the leading edge of the C latent image arrives thereat, the sleeve 15*a* of the unit 15 starts rotating to render the associated developer operative. In this condition, the developing unit 15 develops the C latent image with the C toner. After the trailing edge of the C latent image has moved away from the developing position, the developer on the sleeve 14*a*, i.e., the developing unit 15 is rendered inoperative immediately. The operation of the C developing unit 15 is completed at least before the leading edge of an M latent image to follow arrives at a developing position which is assigned to the M developing unit 16.

Subsequently, an M and a Y imaging process are sequentially executed in the same manner as the BK and C imaging processes. The M and Y processes will not be described since they are identical with the BK and C processes, regarding the steps of reading image data, forming a latent image, and developing the latent image.

As shown in FIG. 2, in the intermediate transfer belt unit, the belt 19 is passed over a drive roller 21, the previously mentioned bias roller 20, and driven rollers which will be described. A motor, not shown, is drivably connected to the drive roller 21. Arranged around the belt 19 are a belt cleaning unit 22 for removing toner images transferred to the belt 19, and a paper transfer unit 23 for transferring the composite four-color toner image from the belt 19 to a paper. The belt cleaning unit 22 has a brush roller 22*a*, a rubber blade 22*b*, and a mechanism 22*c* for moving the unit 22 into and out of contact with the belt 19. While the second, third and fourth toner images are sequentially transferred from the drum 9 to the belt 19 after the first or BK image, the cleaning unit 22 is spaced apart from the belt 19 by the mechanism 22*c*.

The paper transfer unit 23 has a bias roller 23*a*, a roller cleaning blade 23*b*, and a mechanism 23*c* for moving the unit 23 into and out of contact with the belt 19. Usually, the bias roller 23*a* is spaced apart from the belt 19. When the four-color image should be transferred from the belt 19 to a paper at a time, the mechanism 23*c* urges the paper transfer unit 23 against the belt 19. At the same time, a bias voltage is applied to the bias roller 23*a*. As a result, the composite image is transferred from the belt 19 to a paper 24, FIG. 1.

As shown in FIG. 1, the paper 24 is fed by a pick-up roller 25 and a registration roller pair 26 such that it meets the leading edge of the composite image on the belt 19 at the paper transfer position of the paper transfer unit 23.

In the illustrative embodiment, after the toner image of first color, i.e., BK toner image has been transferred to the belt 19 up to the trailing edge thereof, the belt 19 is driven by a reciprocation or quick return system, as follows. As soon as the BK toner image has been fully transferred to the belt 19, the belt 19 is brought out of contact with the drum 9, caused to stop rotating (forward), and then reversed, i.e., returned in the opposite direction at high speed. After the leading edge of the BK toner image on the belt 19 has moved away from a predetermined belt transfer position and further moved a predetermined distance, the reverse rotation of the belt 19 is stopped. When the leading edge of a C toner image on the drum 9 arrives at a predetermined position close to, but short of, the belt transfer position, the belt 19 is again caused to move forward and brought into contact with the drum 9. The C toner image is, of course, transferred to the belt 19 such that it is in accurate register with the BK toner image. The above procedure is also repeated with an M toner image and a Y toner image to complete a four-color belt transfer image. After the belt transfer of the Y or last toner image, the belt 19 is continuously moved forward without being returned. As a result, the composite toner image is transferred from the belt 19 to the paper 24.

The paper 24 carrying the toner image thereon is conveyed to a fixing unit 28 by a conveyor unit 27. The fixing unit 28 fixes the toner image on the paper 24 with a heat roller and a press roller 28*b*. Then, the paper, or full color copy, 24 is driven out of the copier to a tray 29, FIG. 1. After the paper transfer, the drum cleaning unit 10, including a precleaning charger 10*a*, a brush roller 10*b* and a rubber blade 10*c*, cleans the surface of the drum 9. Subsequently, the discharge lamp 11 dissipates charges remaining on the drum 9. On the other hand, the belt cleaning unit 22 is pressed against the belt 19 by the mechanism 22*c* to clean the surface of the belt 19.

In a repeat copy mode, after the first Y (fourth color) imaging process, a second BK (first color) imaging process is executed by the scanner 1 and drum 9. After the transfer of the first full color image from the belt 119 to the paper 24, the second BK toner image is transferred to the area of the belt 19 which has been cleaned by the belt cleaning unit 22. Subsequently, the second full color image is produced on the belt 19 in the same manner as the first full color image.

Paper cassettes 30, 31, 32 and 33, FIG. 1, are each loaded with a stack of papers of particular size. When one of the paper cassettes 30-33 is selected on an operation panel, not shown, the papers are sequentially fed from the cassette to the registration roller pair 26 at a predetermined timing. OHP (Over Head Projector) sheets and relatively thick sheets are fed from a manual tray 34.

The foregoing description has concentrated on a four-color copy mode. In a three- or two-color copy mode, the procedure described above is repeated a number of times corresponding to the colors selected and the desired number of copies. In a single color copy mode, one of the developing units storing the developer of desired color is continuously held in the operative condition, and the belt 19 is continuously driven forward at a constant speed in contact with the drum 9. During the course of this mode, the belt cleaning unit 22 is held in contact with the belt 19.

Figure 3:
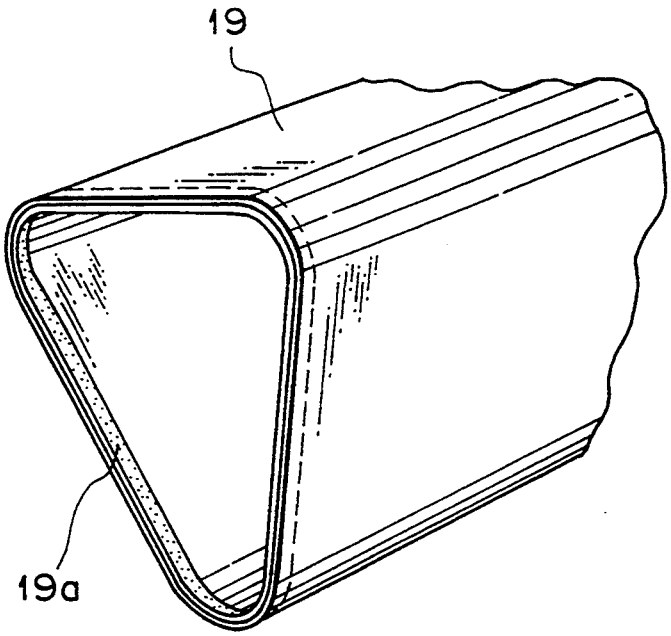
FIG. 3 is a fragmentary perspective view of an intermediate transfer belt also included in the embodiment.
Figure 4:
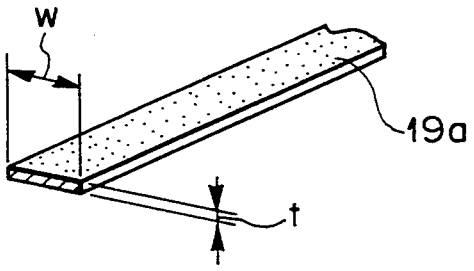
FIG. 4 is a fragmentary perspective view of a guide adhered to the belt.
Figure 5:
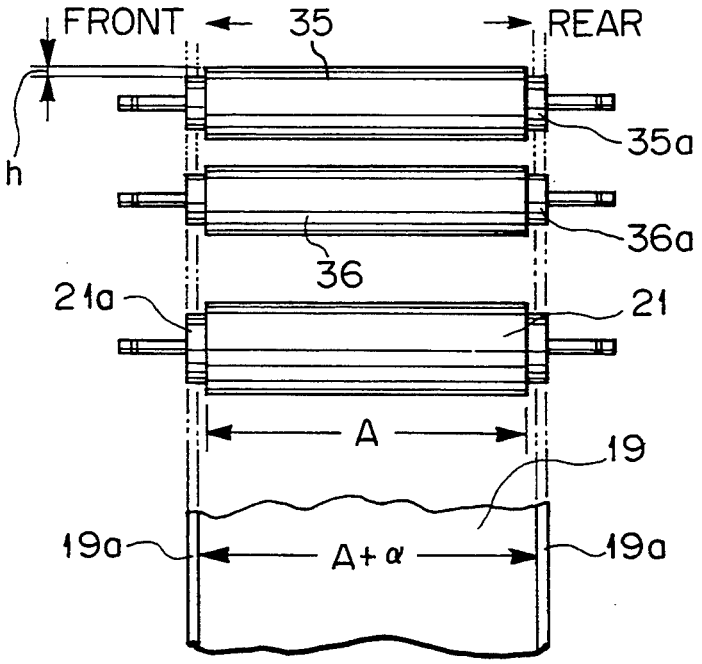
FIG. 5 is a developed plan view indicative of a positional relation between the belt and rollers over which it is passed.
Figure 6:
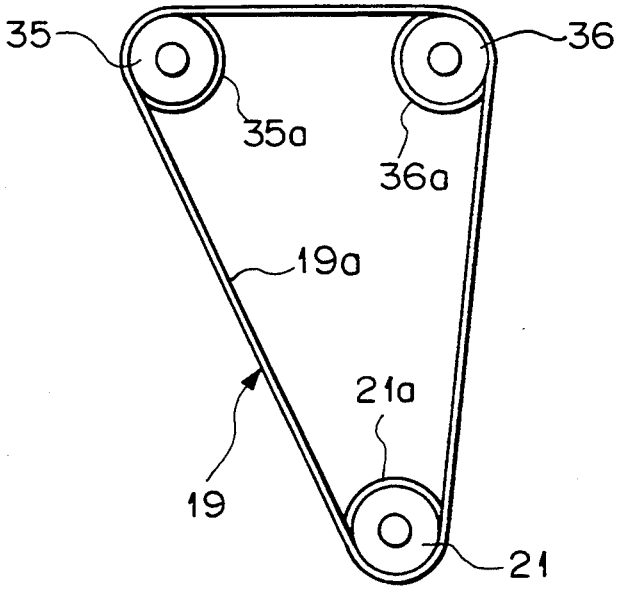
FIG. 6 is a side elevation of the belt and rollers.

As shown in FIG. 3, a guide 19*a* in the form of a band is adhered to each edge of the belt 19 in order to restrict the deviation of the belt 19 while it is in rotation. As shown in FIG. 4 specifically, the guide 19*a* is implemented by a rubber band having a rectangular cross-section which is 5 mm wide (w) and 0.8 mm thick (t). The hardness of the band 19*a* is A 70 as prescribed by JIS (Japanese Industrial Standards). As shown in FIGS. 5 and 6, among the rollers over which the belt 19 is passed, the rollers around which the belt 19 wraps in substantial amounts (e.g. drive roller 21 and driven rollers 35 and 36) are respectively provided with stepped ends 21*a*, 35*a* and 36*a*. The opposite guides 19*a* of the belt 19 are nested in the opposite stepped ends 21*a*, 35*a* and 36*a*. In the illustrative embodiment, the stepped ends 21*a*–36*a* each has a height h ranging from 1 mm to 1.5 mm.

While the belt 19 is rotated in one direction, it deviates to the front side or the rear side, as indicated in FIG. 5 (direction perpendicular to the sheet surface of FIG. 6). However, since the guides 19*a* abut against the associated shoulders of the stepped ends 21*a*–36*a* of the rollers 21-36, any further deviation is usually prevented. As shown in FIG. 5, the belt 19 has a width $A+\alpha$ which is about 1 mm broader than the width A of the rollers 21-36 as measured in the thrust direction.

Figure 7:
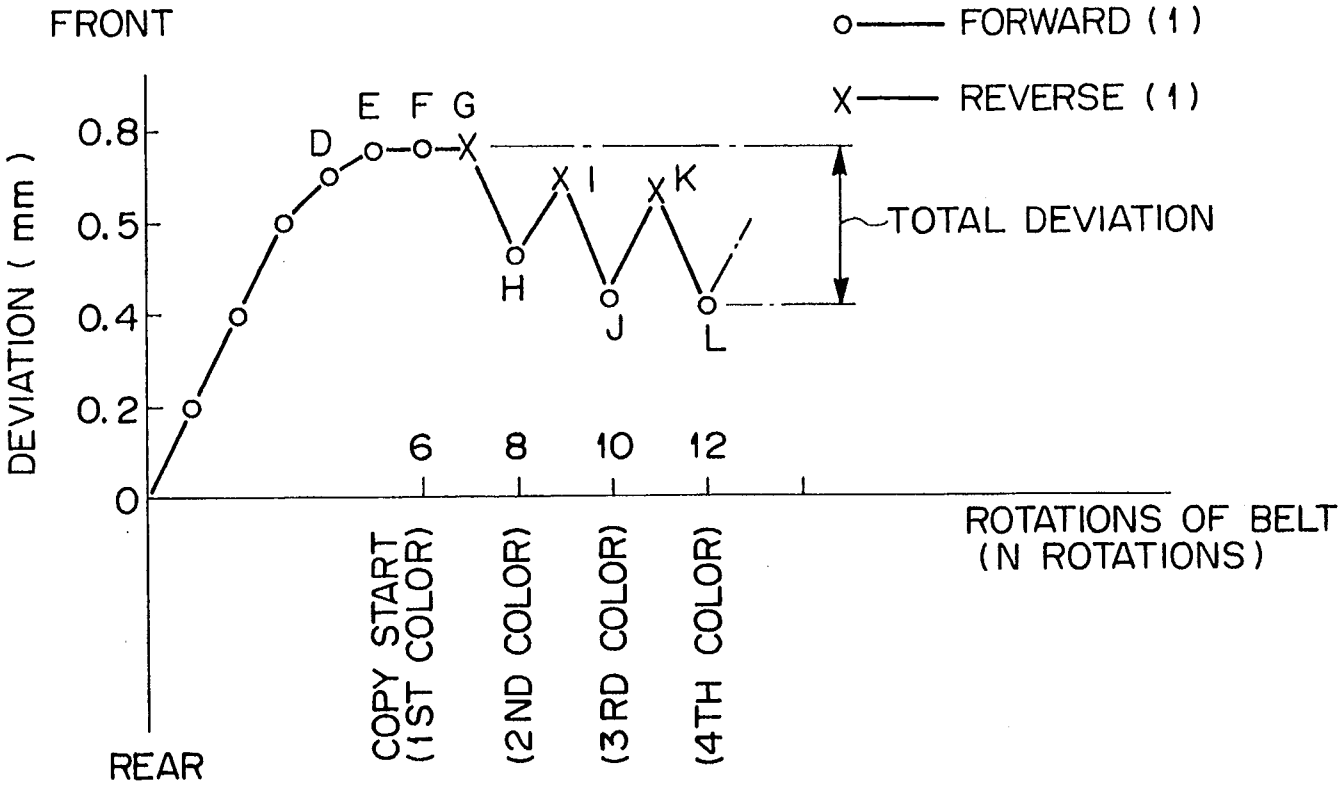
FIG. 7 is a graph representative of a relation between the deviation of an intermediate transfer belt and the number of rotations of the belt.

How the belt 19 behaves during rotation will be described with reference to FIG. 7. At the beginning of operation, the belt 19 rotates forward continuously and, therefore, deviates to one side due to, among others, the degree of parallelism of the rollers 21-36. When the copier is operated to produce a four-color or full color copy, the belt 19 deviates 0 mm (F→G) during forward rotation for the first color. Subsequently, as the belt 19 is reversed, or returned, it deviates noticeably away from the restricting portions; the deviation was measured to be 0.24 mm (G→H). During forward rotation for the second color, the belt 19 was found deviated 0.17 mm (H→I). Presumably, why the deviation during forward rotation for the second color is smaller than the deviation during reverse rotation is as follows. During forward rotation for the second color, the guide 19*a* partly abut against the associated ends of the rollers to restrict the deviation of the belt 19. As a result, the belt 19 fails to fully return to the position G occurred during forward rotation for the first color. The belt 19 repeats such displacements afterwards. When a four-color image is completed on the belt 19, the deviation of the belt 19 is about 0.34 mm. Subsequently, as the reciprocating motion of the belt 19 is repeated, the deviation during forward rotation and the deviation during reverse rotation begin to coincide with each other.

Figure 8:
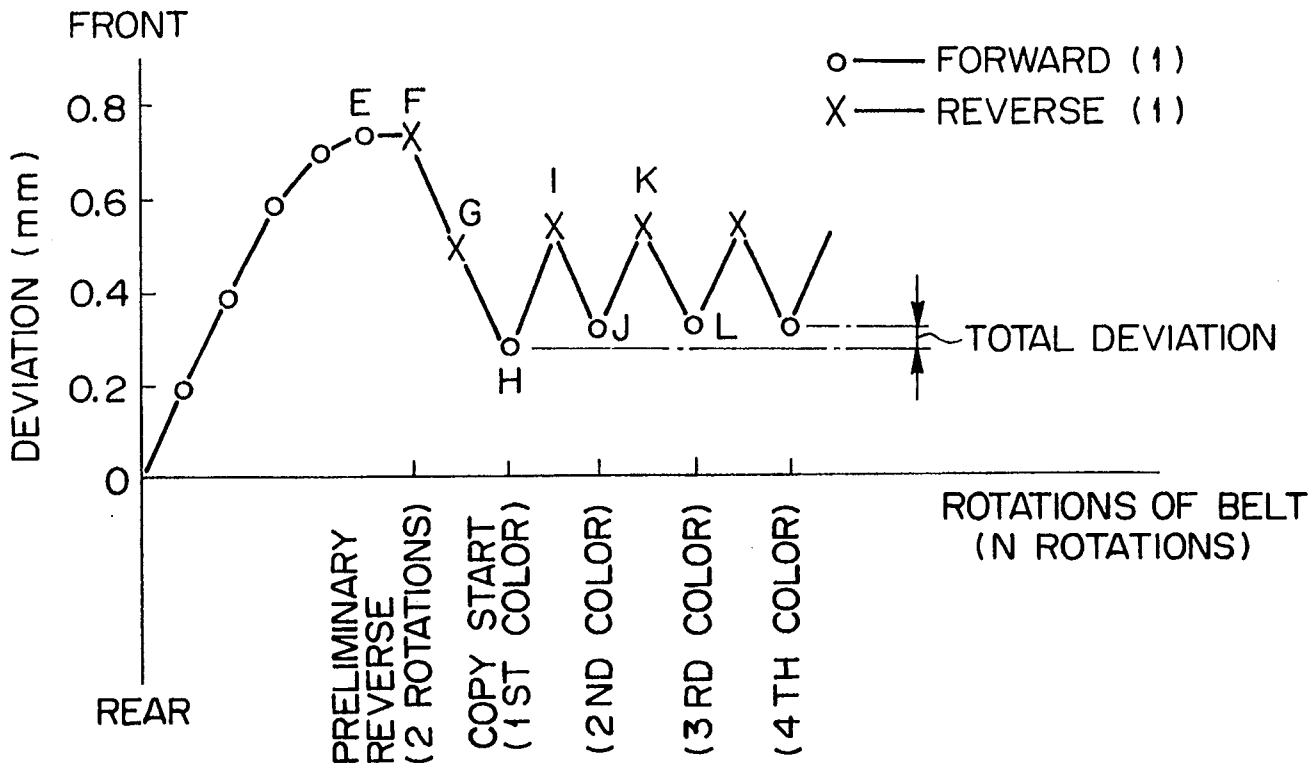
FIG. 8 is a graph representative of a relation between the deviation of the belt and the number of rotations of the belt particular to one embodiment of the present invention.
Figure 9A:
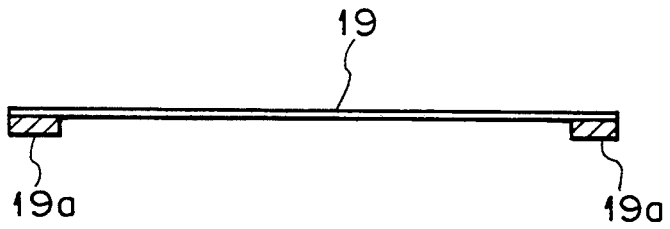
FIGS. 9A and 9B show the guides of the belt in a specific condition.
Figure 9B:
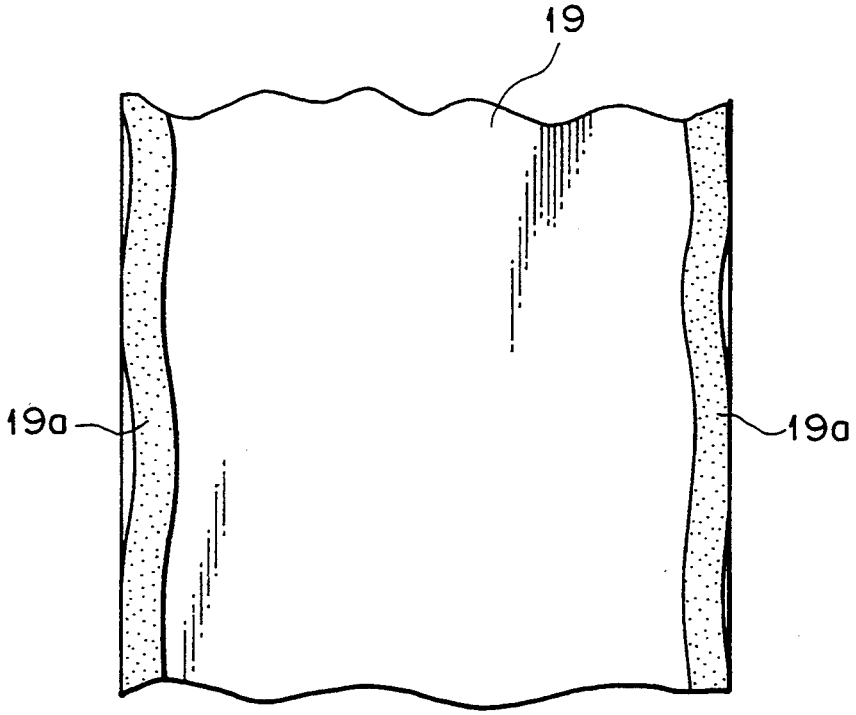

A reference will be made to FIG. 8 for describing the behavior of the belt 19 in accordance with the present invention. As shown, at the beginning of operation, the belt 19 rotates forward continuously and, therefore, deviates to one side, as in FIG. 7. Subsequently, the belt 19 is reversed to move the guides 19*a* sufficiently away from the associated restricting portions (stepped ends of rollers). At this instant, the belt 19, theoretically, should only perform a single rotation in the reverse direction so long as the guide 19*a* does not deform. However, in accordance with the present invention, the belt 1 is caused to perform two rotations in the reverse direction. This is because the guides 19*a* wave due to the limited precision of their adhesion to the belt 19, as shown in FIGS. 9A and 9B.

As a four-color copying cycle begins, the belt 19 deviates 0.2 mm during the above-stated preliminary reverse rotation (G→H) and then deviates 0.26 mm during forward rotation for the first color (H→I). Subsequently, the belt 19 deviates 0.2 mm during reverse rotation for the first color (I→J) and again deviates 0.2 mm during forward rotation for the second color (J→K). In this way, the deviation of the belt 19 becomes substantially stable. When a four-color image is completed on the belt 19, the total deviation of the belt 19 is as small as 0.06 mm. This contributes a great deal to the accurate register of colors which is susceptible to the deviation of the belt 19.

In the illustrative embodiment, as the deviation of the belt 19 per rotation increases, the deviation directly translates into a displacement. It is, therefore, preferable to provide the rollers, over which the belt 19 is passed, with accurate parallelism.

The two preliminary reverse rotations of the belt 19 was successful to obtain favorable results, as described above. However, the number of preliminary reverse rotations should preferably be three or more when the guides 19*a* are easy to deform or when they wave noticeably. Further, when the guides 19*a* are apt to get on the rollers over the restricting portions or stepped ends due to the repeated rotation of the belt 19 in one direction the number of reverse rotations of the belt 19 should preferably be changed in matching relation to the number of rotations of the belt 19 in one direction. In this case, when the number of reverse rotations is increased, it is preferable that the guides 19*a* be prevented from abutting against the opposite restricting portions due to the deviation of the belt 19.

Figure 10:
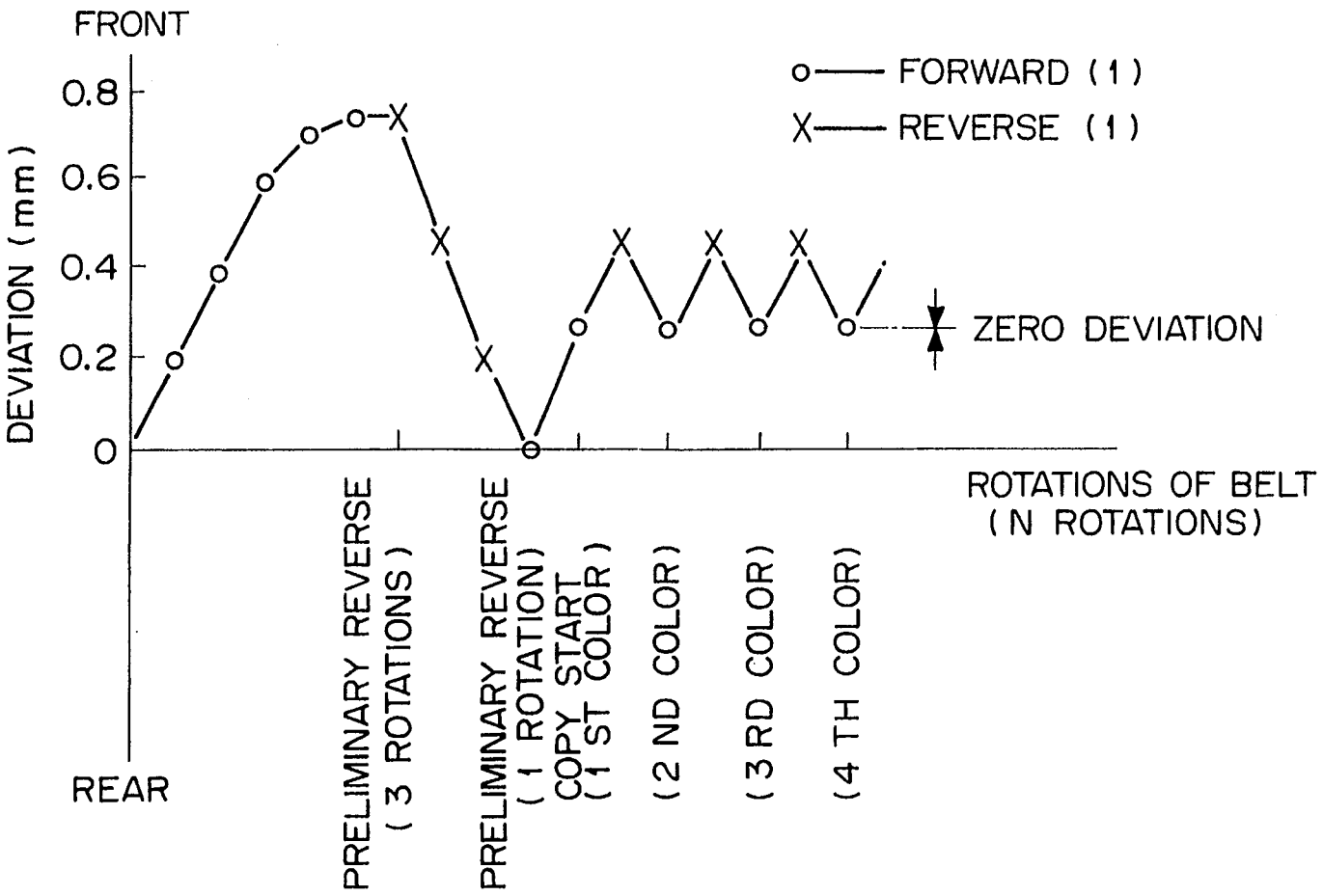
FIG. 10 is a graph representative of a relation between the deviation of the belt and the number of rotations of the belt particular to an alternative embodiment of the present invention.

FIG. 10 shows an alternative embodiment of the present invention in which the belt 19 performs, before copying, three rotations in the reverse direction and then one rotation in the forward direction. This embodiment contemplates to obviate the difference between the deviation of the belt 19 during preliminary reverser rotation (G→H; 0.2 mm) and the deviation during forward rotation for the first color (H→I; 0.26 mm), i.e., the total deviation of 0.06 min.

Figure 11:
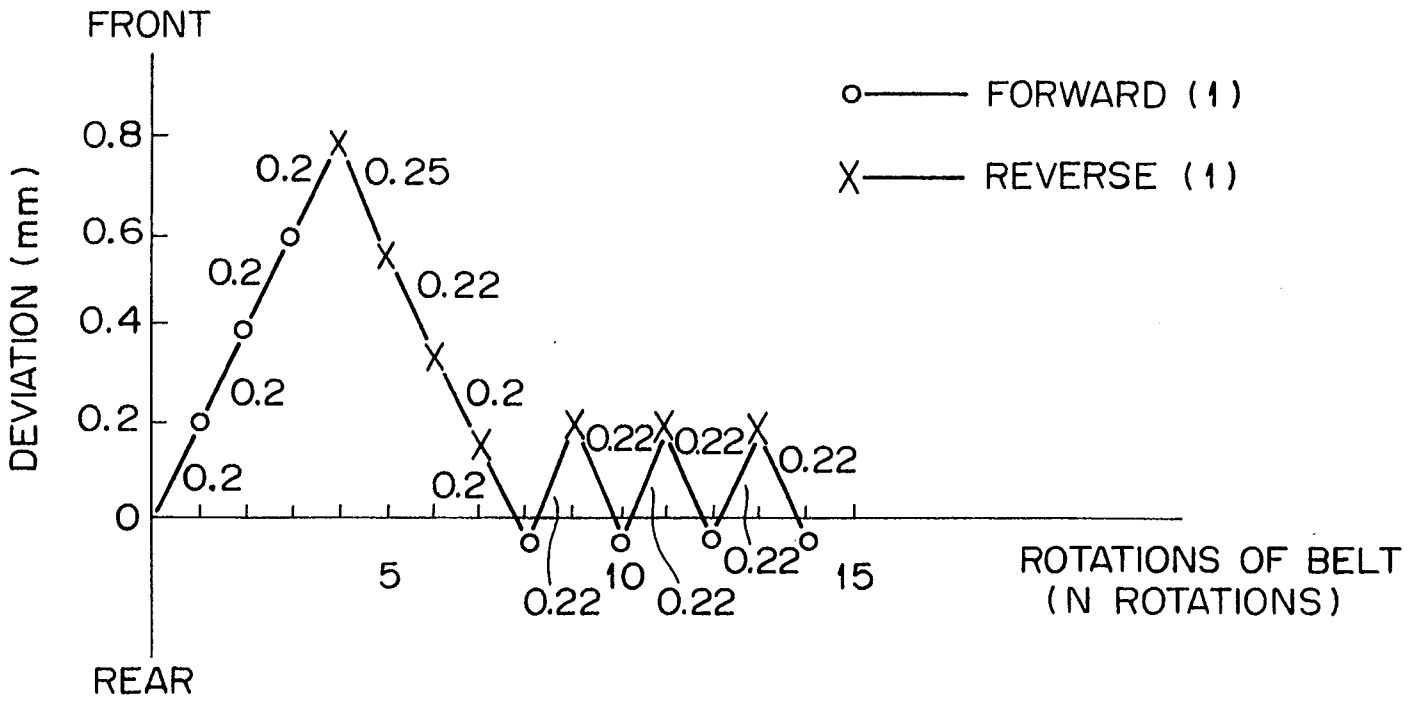
FIG. 11 is a graph representative of a relation between the deviation of the belt and the number of rotations of the belt for the supplementary description of the behavior of the belt included in the alternative embodiment.

To begin with, a reference will be made to FIG. 11 for the supplementary description of the behavior of the belt 19. As shown, assume that as the belt 19 repeats forward rotation, it deviates 0.2 mm for each rotation. Then, the belt 19 also deviates substantially 0.2 mm for each reverse rotation. However, after the continuous forward rotation of the belt 19, the deviation during the first reverse rotation is slightly greater than the deviation during the second and successive reverse rotations. Such a behavior of the belt 19 indicates that by rotating, before copying, the belt 19 three rotations in the reverse direction and then one rotation in the forward direction, it is possible to substantially eliminate the deviation of the belt 19 when a four-color image is completed, although some error occurs each time.

In summary, it will be seen that the present invention provides an image recording apparatus having various unprecedented advantages, as enumerated below.

(1) Before the reciprocation of the belt 19 for belt transfer, the belt 19 is rotated in the opposite direction to the image forming direction to insure accurate register of individual color components.

(2) The belt 19 performs, at such a preliminary stage, at least one rotation, preferably two or more rotations, in the reverse direction. This further promotes accurate register of color components.

(3) The duration or the number of rotations of the belt 19 in the preliminary stage is controlled on the basis of the number of single color copies produced before previously or the number of forward rotations performed by the belt 19 previously. As a result, an accurately registered full color image is achievable without regard to various conditions, including getting on the belt rollers and waving.

(4) After the preliminary reverse rotation, the belt 19 is rotated forward to provide the resulting image with higher quality.

(5) To achieve the above advantage (4), half a rotation to one rotation in the forward direction suffices.

Figure 12A:
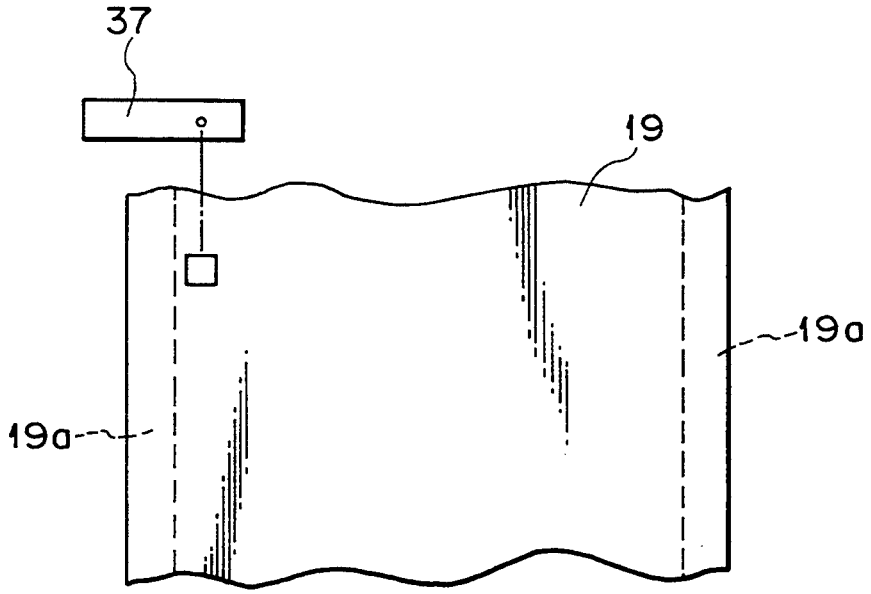
FIGS. 12A and 12B show a positional relation between the belt and belt thrust position sensing means further included in the image recording apparatus.
Figure 12B:
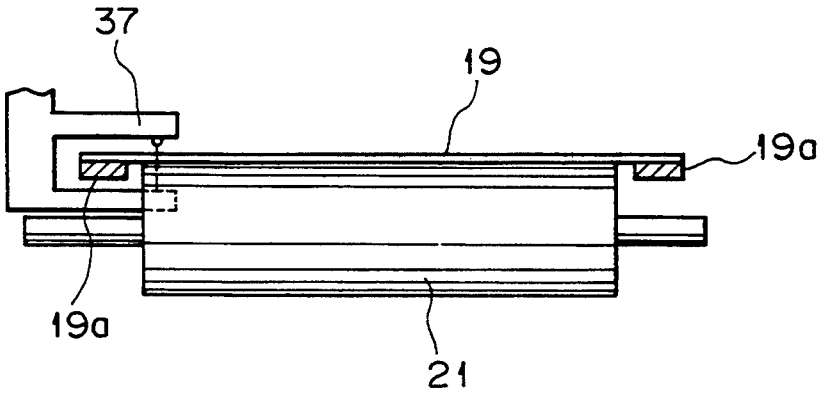

(6) As shown in FIGS. 12A and 12B, a sensor, or belt thrust sensing means, 37 may be used to sense the position of the belt 19 in the thrust direction. Then, whether or not to reverse the belt 19, i.e., whether or not both guides 19*a* are in contact with the associated restricting portions is determined on the basis of the output of the sensor 37. Further, the guides 19*a* can be moved away from the associated restricting portions efficiently and accurately. This is also successful in producing high quality images.

(7) The preliminary movement of the belt 19 occurs just after the operation of a copy start key in a multicolor copy mode or after the transfer of a toner image to a paper or the cleaning of the belt 19. Hence, it is possible to effect the preliminary operation of the belt 19 efficiently without reducing the number of copies per minute (CPM), i.e., by using an interval during which the belt 19 does not directly join in image formation. Such an interval is available when, for example, a document is being read, when a latent image is being developed, or when the paper 24 is being driven out of the copier.

(8) When two or more multicolor copies are to be produced continuously, the belt 19 is rotated forward and reversed the same number of times before the start of forward rotation for the first color of each copy. In this condition, the individual toner images can be accurately superposed one above the other while the guides 19*a* are spaced apart from the associated restricting portions.

(9) The sensor 37 senses not only the position of the belt 19 in the thrust direction, but also the faulty movement of the belt 19. Alarming means, not shown, alerts the operator to the faulty movement of the belt. This obviates defective images as would occur when the belt fails to fully return even after the predetermined number of rotations, the breakage of the belt 19, etc. In addition, the sensor 37, serving as belt thrust position sensing means and belt fault detecting means at the same time, reduces the cost of the apparatus.

Various modifications will become possible for those skilled in the art after receiving the teachings of the present disclosure without departing from the scope thereof.

What is claimed is:

1. An image recording apparatus comprising:

an image carrier for sequentially forming toner images of respective colors on a surface thereof;

an intermediate transfer belt passed over a plurality of rollers and rotatable in a reciprocating motion, said intermediate transfer belt having guides at opposite edges thereof for being prevented from deviating;

the toner images being transferred from said image carrier to said intermediate transfer belt, which is in a reciprocation motion, one above the other, and then a resulting composite toner image being transferred to a recording medium;

said intermediate transfer belt being rotated, before sequential transfer of the toner images to said intermediate transfer belt, in a reverse direction opposite to a direction for image formation.

2. An apparatus as claimed in claim 1, wherein said intermediate transfer belt is caused to rotate at least one rotation, preferably two or more rotations, in the reverse direction.

3. An apparatus as claimed in claim 1, wherein said intermediate transfer belt is rotated in a forward direction after the rotation in the reverse direction.

4. An apparatus as claimed in claim 3, wherein said intermediate transfer belt is caused to rotate half a rotation to one rotation in the forward direction.

5. An apparatus as claimed in claim 1, further comprising thrust position sensing means for sensing a position of said intermediate transfer belt in a thrust direction, whereby whether or not to rotate said intermediate transfer belt in the reverse direction is determined in response to an output of said thrust position sensing means.

6. An apparatus as claimed in claim 5, wherein said belt thrust position sensing means detects a faulty movement of said intermediate transfer belt while sensing the position in the thrust direction.

7. An apparatus as claimed in claim 6, further comprising alarming means for alerting an operator to the faulty movement of said intermediate transfer belt.

8. An apparatus as claimed in claim 1, further comprising control means for controlling a duration or a number of times of rotations of said intermediate transfer belt in the reverse direction on the basis of a number of single color copies produced previously or a number of forward rotations performed by said intermediate transfer belt previously.

9. An apparatus as claimed in claim 1, wherein a movement of said intermediate transfer belt occurs just after a copy start key has been operated in a multicolor copy mode or after transfer of the composite toner image to the recording medium or cleaning of said intermediate transfer belt.

10. An apparatus as claimed in claim 1, wherein when two or more copies each carrying the composite toner image thereon are to be produced, said intermediate transfer belt is rotated in the forward direction and the reverse direction a same number of times before a start of forward rotation for the first color of each copy.

* * * * *